US005779070A

United States Patent [19]

Dickinson et al.

[11] Patent Number: 5,779,070

[45] Date of Patent: Jul. 14, 1998

[54] ADJUSTABLE SHELVING APPARATUS

[75] Inventors: Thomas Dickinson; Bradley D. Gale, both of St. Louis, Mo.

[73] Assignee: Contico International, Inc., St. Louis, Mo.

[21] Appl. No.: 556,267

[22] Filed: Nov. 10, 1995

[51] Int. Cl.[6] ..... A47B 43/00

[52] U.S. Cl. ..... 211/187; 211/181; 108/144

[58] Field of Search ..... 211/187, 181, 211/208, 133; 108/144

[56] References Cited

U.S. PATENT DOCUMENTS

| | | |
|---|---|---|
| 3,424,111 | 1/1969 | Maslow . |
| 3,523,508 | 8/1970 | Maslow . |
| 3,604,369 | 9/1971 | Maslow . |
| 3,675,598 | 7/1972 | Kesilman et al. . |
| 3,757,705 | 9/1973 | Maslow . |
| 4,138,953 | 2/1979 | Tashman . |
| 4,318,352 | 3/1982 | Friedman et al. . |
| 4,444,125 | 4/1984 | Welsch et al. . |
| 4,595,107 | 6/1986 | Welsch . |
| 4,615,278 | 10/1986 | Cabrelli . |
| 4,627,543 | 12/1986 | Nicely . |
| 4,754,712 | 7/1988 | Olson et al. . |
| 4,799,818 | 1/1989 | Sudimak et al. . |
| 4,895,381 | 1/1990 | Farlow ..... 211/208 |
| 5,127,342 | 7/1992 | Taylor . |
| 5,303,645 | 4/1994 | Meacham . |

*Primary Examiner*—Leslie A. Braun
*Assistant Examiner*—Willie Berry, Jr.
*Attorney, Agent, or Firm*—Howell & Haferkamp, L.C.

[57] ABSTRACT

Adjustable shelving apparatus comprises a shelf, at least one upright post, and at least one collar. The collar grips the post at any one of a plurality of discrete positions along the post and has an outer surface sized for a snug fit in a collar-receiving socket of the shelf. At least part of the collar is resiliently flexible and has a locking element which can be moved into and out of engagement with locking elements along the post by resiliently flexing the collar.

47 Claims, 5 Drawing Sheets

20
22
72
30
28
30
28
30
28
72
28
24
32
32
32
94
26
32
32
32

ADJUSTABLE SHELVING APPARATUS

BACKGROUND OF THE INVENTION

This invention relates to adjustable shelving apparatus and more particular to adjustable shelving apparatus of the type having shelves whose heights are adjustable relative to supporting posts.

Conventional shelving structures have shelves supported by four posts. The posts have a plurality of axially-spaced circumferential grooves. Tapered sleeves surround the posts and are sized for fitting into downwardly opening sockets in the shelves. The sleeves have ribs on their inner surfaces for engaging the grooves of the posts. Engagement of the ribs and the grooves prevents axial movement of the sleeves relative to the posts. The sleeves adjustably support the shelves on the posts.

With many of these conventional shelving structures, the sleeves are configured so that the ribs are radially spaced from grooves of the post unless an external clamping force is applied to the sleeves. This external force is generally provided by wedging the tapered sleeves into the sockets to urge the ribs into engagement with the grooves. In other words, the sleeves are free to axially slide along the posts when they are not wedged into the sockets of the shelves.

A disadvantage of these shelving structures is that it is difficult for an installer to wedge four sleeves into the four corner sockets of a shelf when assembling the structure or adjusting the height of the shelf. When attempting to wedge one of the sleeves into a socket, the installer might need to raise another corner of the shelf which might disengage the socket of that corner from its associated sleeve to thereby undesirably allow that sleeve to slide (or fall) down the post. The installer will then have to reinsert the fallen sleeve into its associated corner socket without dislodging one of the other sockets from its sleeve. Moreover, if the assembled structure is bumped, one or more of the corner sockets might disengage from its associated sleeve and allow the sleeve to slide down the post, thereby jeopardizing the stability of the shelf.

Another type of conventional shelving structure has sleeves with projections on their inner surfaces adapted to engage dimples on the posts. A disadvantage associated with this type of structure is that the projections engage the dimples only when the projections and dimples are circumferentially aligned. If the dimples and projections become circumferentially misaligned, the sleeve is free to slide up and down the post.

SUMMARY OF THE INVENTION

Among the several objects of the present invention may be noted the provision of an improved adjustable shelving apparatus; the provision of such apparatus having collars which may be quickly and easily attached to support posts; the provision of such apparatus in which the collars are releasably locked to the posts independent of any external clamping force; the provision of such apparatus in which the sleeves may be releasably locked against the post regardless of the circumferential positions of the sleeves on the posts; and the provision of such apparatus which is of relatively simple construction.

In general, an adjustable shelving apparatus of the present invention comprises at least one shelf, at least one upright post, and at least one collar. The shelf has a support surface for supporting articles placed thereon and at least one opening through the support surface. The post is sized for extending through the opening in the support surface. The post has a plurality of lock elements on its surface. The collar is positionable on the post and has an inner surface, an outer surface, and at least one lock element on the inner surface of the collar engageable with the lock elements of the post.

The lock elements of the post and the lock element of the collar are shaped and configured for preventing axial movement of the collar relative to the post when the lock element of the collar engages at least one of the lock elements of the post. The collar is resiliently moveable between a gripping position and a release position. The lock element of the collar engages at least one of the lock elements of the post when the collar is positioned on the post and is in its gripping position to lock against axial displacement of the collar relative to the post. The lock element of the collar is radially spaced from the lock elements of the post when the collar is in its release position to permit axial displacement of the collar relative to the post. The resiliency of the collar biases the collar in its gripping position independent of any external forces pressing against the collar to releasably maintain engagement of the lock element of the collar with said at least one of the lock elements of the post. The lock element of the collar and the lock elements of the post are shaped and configured for locking against axial movement of the collar relative to the post regardless of the circumferential position of the collar relative to the post.

The opening through the support surface of the shelf comprises a collar-receiving socket for receiving the collar. The collar-receiving socket and the outer surface of the collar are shaped and configured for a friction fit of the collar in the socket so that the collar supports the shelf on the post.

In another aspect of the present invention, the post has a plurality of spaced circumferential grooves in the surface thereof. The collar has an inner surface, an outer surface, and at least one lock element projecting radially inwardly from the inner surface of the collar for extending into one of the circumferential grooves of the post. The grooves of the post and the lock element of the collar are shaped and configured for preventing axial movement of the collar relative to the post when said lock element of the collar extends into one of the grooves of the post.

The collar is resiliently deformable between a gripping position and a release position. The lock element of the collar extends into one of the grooves when the collar is in its gripping position and at least partially encompasses the post to lock against axial displacement of the collar relative to the post. The lock element of the collar is radially spaced from the grooves of the post when the collar is in its release position to permit axial displacement of the collar relative to the post.

In a further aspect of the present invention, an adjustable shelving apparatus comprises at least one collar configured for partially encompassing a post. The collar has an inner surface engageable with the surface of the post, an outer surface, and first and second camming surfaces spaced apart to define a gap therebetween. The inner surface of the collar defines a post-receiving cavity. The collar is resiliently moveable between first and second positions. In the first position, the gap is at least as wide as the diameter of the post to permit insertion of the post into and removal of the post from the post-receiving cavity via the gap. In the second position, the gap is less than the diameter of the post.

The inner surface of the collar and the surface of the post are shaped and configured for resisting relative lateral movement between the post and collar and for resisting relative axial movement between the post and collar when the post is within the post-receiving cavity of the collar and when the inner surface of the collar is in engagement with the surface of the post. The collar is shaped and configured so that when the collar is in a relaxed position and the camming surfaces are in engagement with the surface of the post, movement of the collar laterally towards the axis of the post causes resultant forces from the surface of the post to press against the camming surfaces thereby to resiliently increase the gap sufficiently to facilitate passage of the post through the gap and into the post-receiving cavity independent of any other forces tending to widen the gap. The relaxed position of the collar is defined as the position which the collar assumes when substantially no external forces act on the collar to widen or narrow the gap between the first and second camming surfaces. The gap between the first and second camming surfaces is less than the diameter of the post when the collar is in its relaxed position.

In yet another aspect of the present invention, a collar of an adjustable shelving apparatus includes a collar body configured for at least partially encompassing the post and a resilient tab connected to the collar body. The collar body has an inner surface defining a post-receiving cavity and an outer surface. The resilient tab has an inner surface engageable with the surface of the post and is resiliently moveable in a plane generally perpendicular to the axis of the post when the post is in the post-receiving cavity of the collar between a post engaging position and a release position. The inner surface of the resilient tab engages the surface of the post when the resilient tab is in its post engaging position. The inner surface of the resilient tab is radially spaced from the surface of the post when the resilient tab is in its release position.

The inner surface of the resilient tab and the surface of the post are shaped and configured for preventing axial movement of the collar relative to the post when the resilient tab is in its post engaging position, the collar is axially slidable on the post when the resilient tab of the collar is in its release position.

In yet another aspect of the present invention, a support collar is configured for partially encompassing the post and has an inner surface engageable with the surface of the post, an outer surface, and first and second side edges spaced apart to define a gap extending therebetween from one end of the collar to the other. The collar is resiliently expandable to widen the gap for facilitating emplacement of the collar around and removal of the collar from the post. The collar-receiving socket of the shelf includes a radially inwardly extending protrusion configured for extending through the gap of the collar and engaging the surface of the post for minimizing wobbling of the shelf relative to the post when the collar is on the post and is snugly fit in the collar-receiving socket.

In yet another aspect of the present invention, an adjustable shelving apparatus comprises a shelf, an upright post, and a collar. The post comprises upper and lower post sections and a resilient snap connector generally at the end of one of the upper and lower post sections for releasably connecting the post sections end-to-end.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
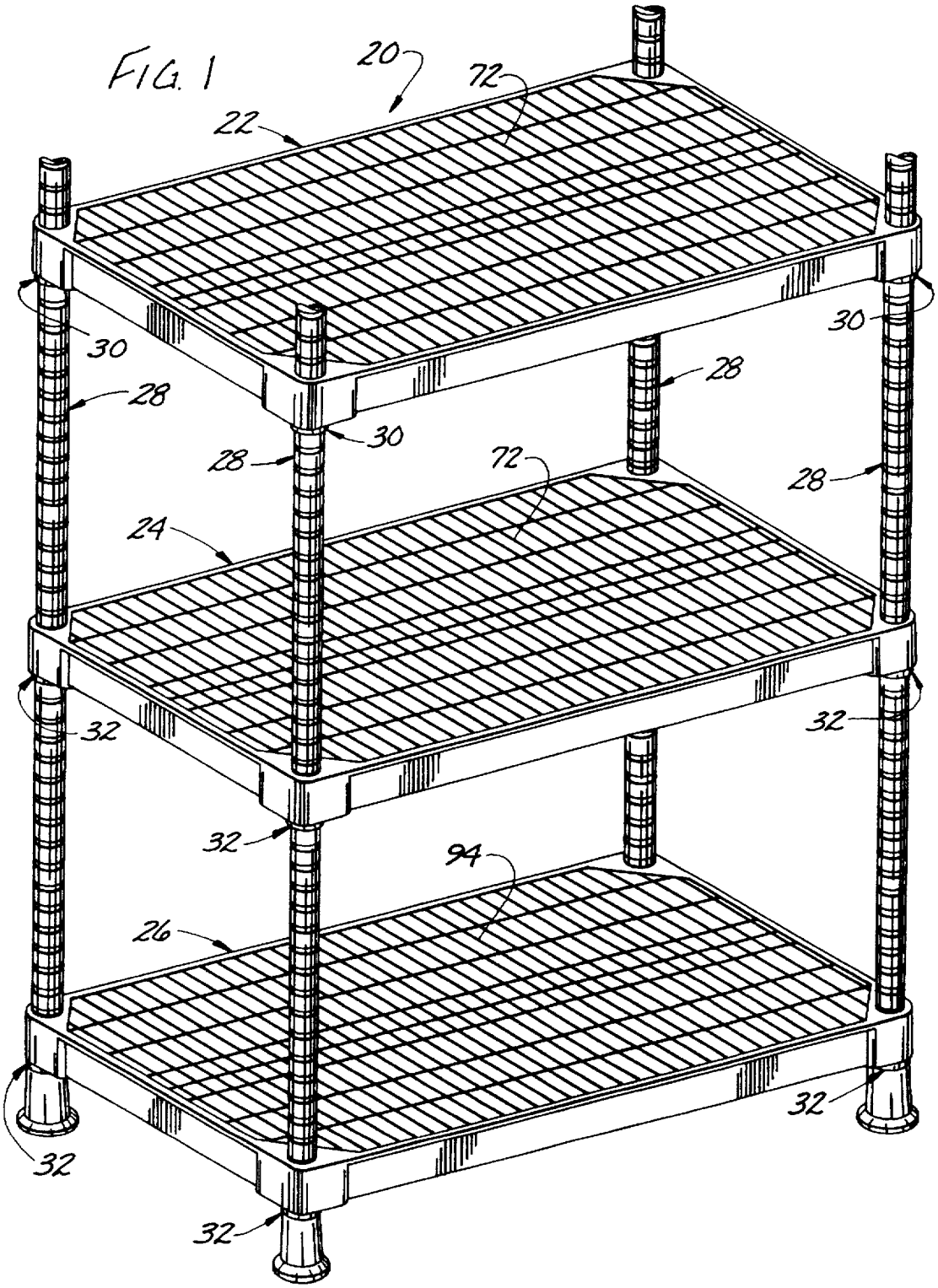
FIG. 1 is a perspective view of an adjustable shelving apparatus of the present invention.

Referring now to the drawings, and first more particularly to FIG. 1, shelving apparatus is indicated in its entirety by the reference numeral 20. The shelving apparatus 20 comprises upper, middle, and lower shelves, generally indicated at 22, 24, and 26, respectively, four upright posts, generally indicated at 28, a plurality of first collars, generally indicated at 30, and a plurality of second collars, generally indicated at 32. As described in greater detail below, the first collars 30 adjustably clamp to the posts 28 along any one of several axial positions and extend into sockets formed at the corners of the upper and middle shelves 22, 24 to support these shelves on the posts. As also described below, the second collars 22 adjustably clamp to the posts 28 along any one of several axial positions and extend into sockets formed at the corners of the lower shelf 26 to support the lower shelf on the posts.

Although described as employing two different types of collars, it is to be understood that all shelves could alternatively be supported by either the first collars or by the second collars without departing from the scope of this invention. Also, although the shelving apparatus 20 is described as having three shelves, it is to be understood that it could have any number of shelves without departing from the scope of this invention.

Figure 2:
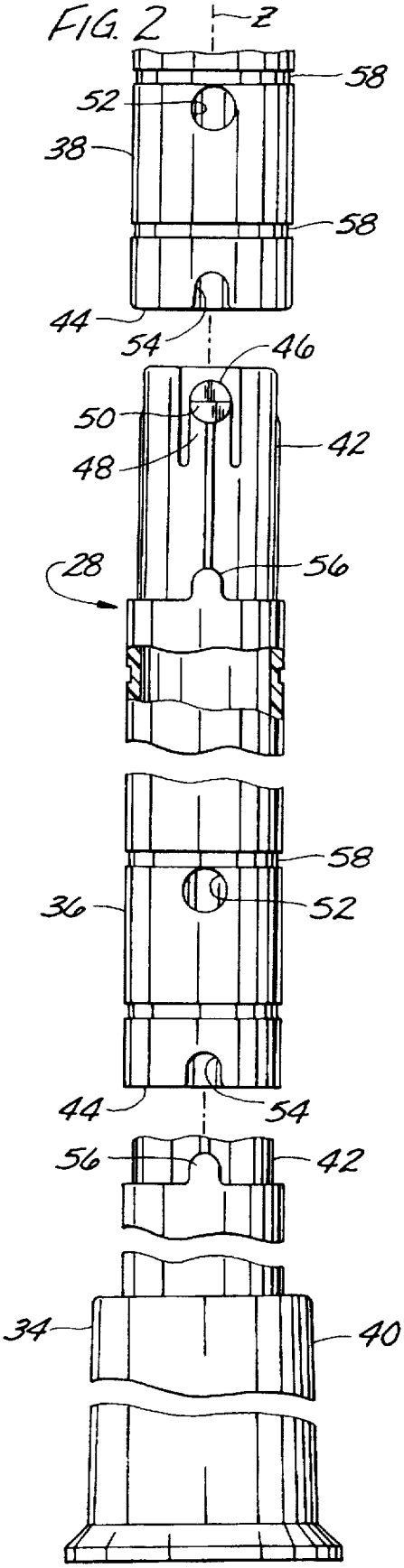
FIG. 2 is a fragmented, exploded side elevational view of a post of the adjustable shelving apparatus of FIG. 1 with portions broken away to show detail.
Figure 3:
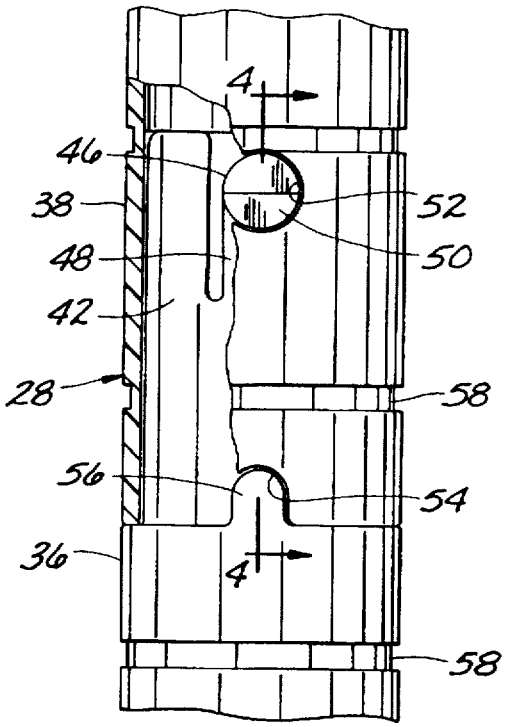
FIG. 3 is a fragmented side elevational view of two connected post sections of the post of FIG. 2 with portions broken away to show detail.
Figure 4:
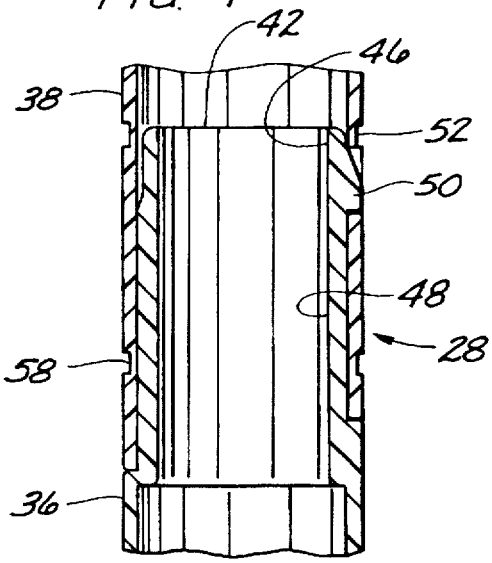
FIG. 4 is a cross-sectional view taken along the plane of line 4—4 of FIG. 3.

Referring now to FIGS. 2–4, each post 28 comprises a plurality of elongate tubular post sections connected end-to-end in a telescoping configuration. The number of post sections used will depend on the desired height for the shelving apparatus. To simplify discussion, however, each post 28 is described herein as having three sections: a base post section 34; an intermediate post section 36; and an upper post section 38.

The base post section 34 has a foot 40 at its lower end for standing on the ground or on a floor. The upper ends of the base and intermediate post sections 34, 36 have tubular male fittings 42 sized for insertion into female fittings 44 at the lower ends of the intermediate and upper post sections 36, 38. Each male fitting 42 includes a resilient snap connector 46 for releasably locking the post sections end-to-end. The snap connector 46 comprises an upwardly extending arm 48 and a finger 50 extending radially outward from the upper end of the arm. Each female fitting 46 includes an opening 52 through the wall of its associated post for receiving the finger 50 of the snap connector 46. The lower end of each female fitting 46 includes a keyway 54 for receiving a protrusion (or key) 56 on each male fitting 42. The male and female fittings 42 and 46 are configured such that the finger 50 of the snap connector 46 is aligned with and extends into the opening 52 when the key 56 is inserted into the keyway 54. The key 56 and keyway 54 ensure proper alignment of the snap connector 46 and opening 52 and also prevent relative circumferential movement of adjacent post sections (i.e., they prevent rotation of one post section relative to another post section about the longitudinal axis Z of the post).

Preferably, the outer surface of each post section has the shape of right circular cylinder and has a plurality of circumferential, annular grooves 58 spaced at substantially equal intervals along the length thereof. Also preferably, the post sections are configured so that when they are connected end-to-end, then the assembled post 28 has a substantially uninterrupted pattern of spaced grooves along its entire length. As shown in FIG. 3 for example, the spacing between the lowermost groove 58 of the intermediate post section 36 and the uppermost groove of the base post section 34 is substantially equal to the interval between other adjacent grooves.

Referring now to FIGS. 5–9, each first collar 30 is generally C-shaped as viewed from either of its ends (e.g., its upper end as viewed in FIG. 5) or as viewed in transverse cross-section. The first collar 30 (also referred to as the C-shaped collar) is shaped and configured for partially encompassing the post 28. It comprises an inner surface 60, an outer surface 62, first and second side edges 64, 66 and two arcuate-shaped tongues 68 extending radially inward from the inner surface. The inner surface 60 of the C-shaped collar 30 is engageable with the surface of the post 28 and defines a post-receiving cavity 70. Preferably, the tongues 60 of the collar 30 are axially spaced apart a distance equal to the spacing between two adjacent grooves 58 of the post 28. The tongues 60 are shaped and configured for extending into (i.e., engaging) the grooves 58 of the post 28 when the post is positioned in the post-receiving cavity 70 to lock against axial movement of the collar relative to the post. The first and second side edges 64, 66 of the collar 30 are spaced apart to define a gap therebetween extending from one end of the collar to the other. As described below, the first and second side edges 64, 66 constitute camming surfaces configured for slidably engaging the surface of the post 28 during emplacement of the collar 30 on the post.

Figure 5:
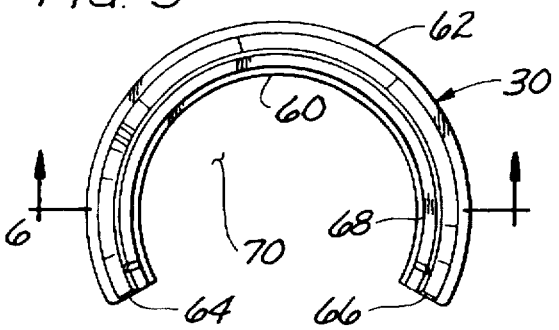
FIG. 5 is a top plan view of a first type of collar for supporting upper and middle shelves of the adjustable shelving apparatus of FIG. 1 on the posts.
Figure 6:
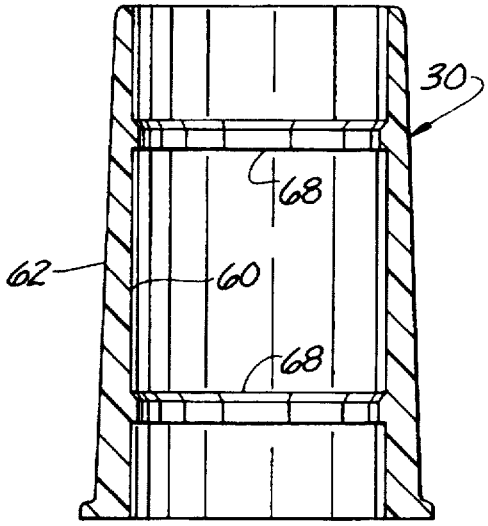
FIG. 6 is a cross-sectional view taken along the plane of line 6—6 of FIG. 5.
Figure 7:
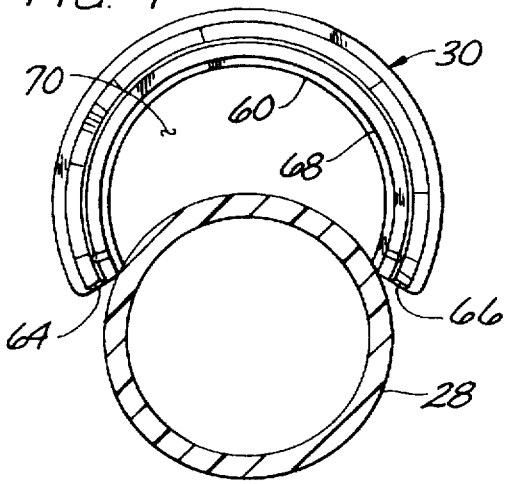
FIG. 7 is a top plan view of the collar of FIG. 5 in a relaxed position and with side edges of the collar in engagement with the surface of the post.
Figure 9:
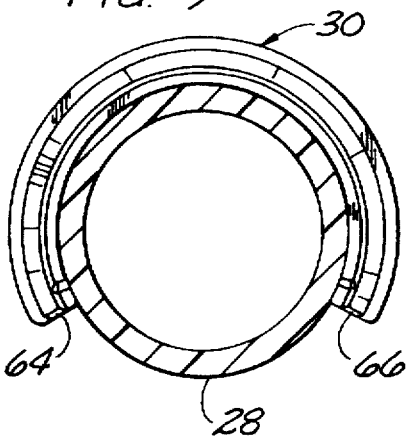
FIG. 9 is a top plan view of the collar of FIGS. 7 and 8 with the post fully inserted in a post-receiving cavity of the collar.
Figure 8:
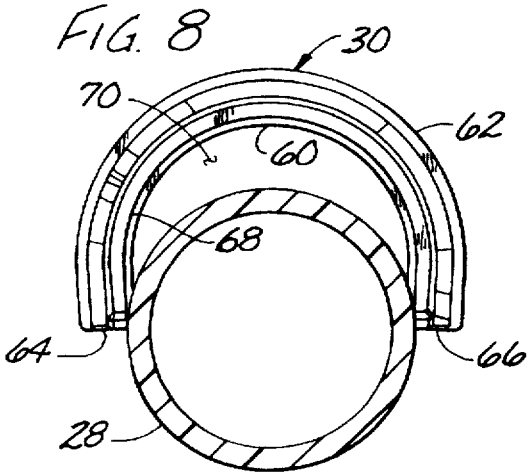
FIG. 8 is a top plan view of the collar of FIG. 7 in a flexed position, i.e., with the side edges of the collar pried open by the post so that the side edges are spaced apart equal to the diameter of the post.
Figure 10:
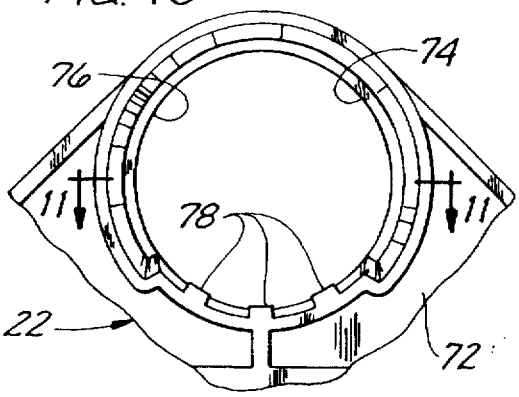
FIG. 10 is a fragmented bottom plan view of the upper shelf of the shelving apparatus of FIG. 1 showing a collar-receiving socket.
Figure 11:
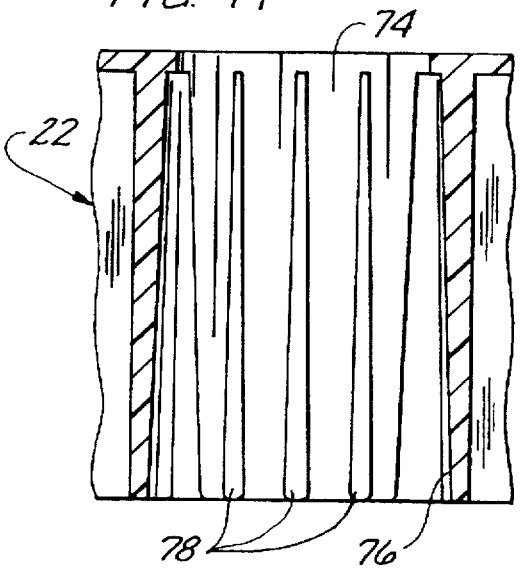
FIG. 11 is a cross-sectional view taken along the plane of line 11—11 of FIG. 10.

The C-shaped collar 30 is resiliently flexible and is preferably of nylon or any other suitable resilient material. It is shown in FIGS. 5, 7 and 9 in a relaxed position, i.e., the position which the collar assumes when substantially no external forces act on the collar to widen or narrow the gap between the first and second edges 64, 66. The collar 30 is resiliently moveable between its relaxed position and a flexed position. As shown in FIG. 7, when the collar 30 is in its relaxed position, the gap between the first and second edges 64, 66 is less than the diameter of the post 28. When the collar 30 is in its flexed position, the gap of the collar 30 is at least as wide as the diameter of the post 28 to permit insertion of the post into and removal of the post from the post-receiving cavity 70 via the gap.

To place the C-shaped collar 30 on the post 28, the side edges 64, 66 of the collar are moved laterally into engagement with the surface of the post. Further lateral movement of the collar 30 towards the axis Z of the post 28 causes resultant forces from the surface of the post to press outwardly against the side edges 64, 66 to resiliently force the collar to its flexed position to facilitate passage of the post through the gap and into the post-receiving cavity 70 independent of any other forces tending to widen the gap.

Preferably, when the collar 30 is in its relaxed position, its inner surface 60 has a radius of curvature substantially equal to the radius of curvature of the surface of the post 28 and forms an arc which is greater than $\pi$ radians but less than approximately $1\frac{1}{3}\ \pi$ radians. With an arc of this size and shape, the collar 30 may be readily snapped onto and removed from the post 28 without the need to pry the gap open with anything other than the surface of the post. Also, since the radius of curvature of the inner surface 60 in its relaxed position is substantially equal to the radius of curvature of the post 28, the collar 30 is in its relaxed position when the post is fully inserted in the post-receiving cavity 70 and when the tongues 68 extend into the grooves 58. However, it is to be understood that the radius of curvature of the collar 30 in its relaxed position alternatively could be smaller than the radius of curvature of the post 28, as long as the gap between the side edges 64, 66 of the collar is less than the diameter of the post when the post is fully inserted in the post-receiving cavity 70.

Figure 12:
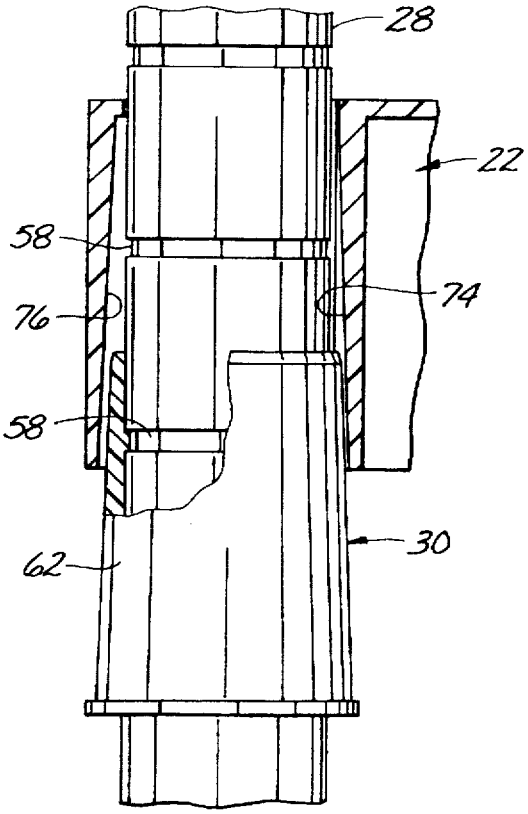
FIG. 12 is a fragmented side-elevational view of the post, collar and shelf with portions broken away to show detail, showing the collar surrounding the post and partially inserted into the collar-receiving socket.
Figure 13:
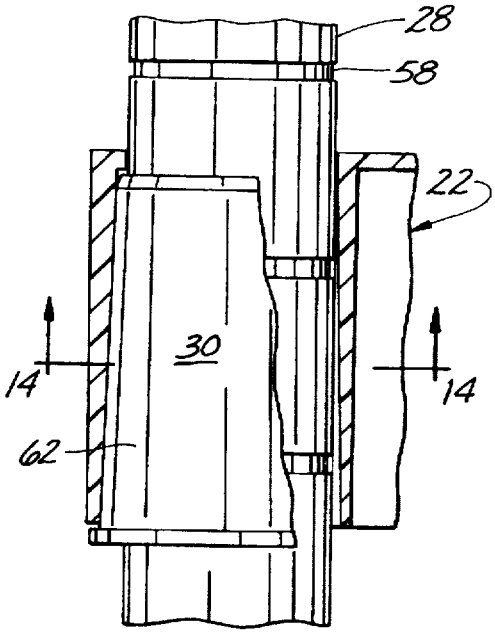
FIG. 13 is a view similar to FIG. 12 except showing the collar fully inserted into the collar-receiving socket.
Figure 14:
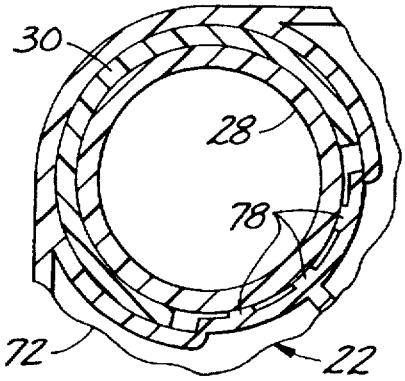
FIG. 14 is a cross-sectional view taken along the plane of line 14—14 of FIG. 13.

Referring now to FIGS. 10–14, the upper and middle shelves 22, 24 each have a support surface 72 for supporting articles placed thereon, and four through openings 74 adjacent the four corners of the shelf. The openings 74 constitute collar-receiving sockets for receiving the C-shaped collars 30. Each collar-receiving socket 74 (FIGS. 10 and 11) is defined by a substantially smooth collar engaging surface 76 engageable with the C-shaped collar 30 and a plurality of inwardly extending ribs 78 engageable with the surface of the post 28. The collar-receiving socket 74 and the outer surface 62 of the C-shaped collar 30 are shaped and configured for a sliding friction fit of the collars in the sockets when the collar is positioned on the post. In particular, the outer surface 62 of each collar 30 tapers generally from bottom to top (as shown in FIG. 12 and 13) and the collar-engaging surface 76 of the socket 74 likewise tapers from bottom to top (as also shown in FIGS. 12 and 13). When the C-shaped collar 30 is positioned on the post 28 and inserted upward into the collar-receiving socket 74 (see FIGS. 12 and 13), the tapered outer surface 62 of the collar cooperates with the tapered collar-engaging surface 76 of the socket to snugly hold the collar in the socket. With the collar 30 so positioned, the ribs 78 (see FIG. 14) of the socket extend radially inwardly through the gap of the collar and engage the surface of the post 28 for minimizing wobbling of the shelf relative to the post. The ribs 78 also function as an alignment guide for ensuring proper alignment of the collar 30 in the socket 74 as the collar is inserted in the socket and for preventing rotation of the collar relative to the socket.

Although the socket 74 is shown as having ribs, it is to be understood that inwardly extending protrusions of other shapes may be employed without departing from the scope of this invention.

Referring now to FIGS. 15–19, each second collar 32 comprises a collar body 80 configured for encompassing the post 28, and upper and lower resilient tabs 82, 84 connected to and integrally formed with the collar body. The collar body 80 has a generally cylindric inner surface 86 (FIG. 18) and an outer surface 88. The inner surface 86 defines a post-receiving cavity 90 for receiving the post 28. Preferably, the inner surface 86 of the collar body 80 has a diameter slightly larger than the diameter of the post 28 so that the second collar 32 may be axially slid (i.e., slid up and down as viewed in FIG. 15) along the length of the post.

Figure 16:
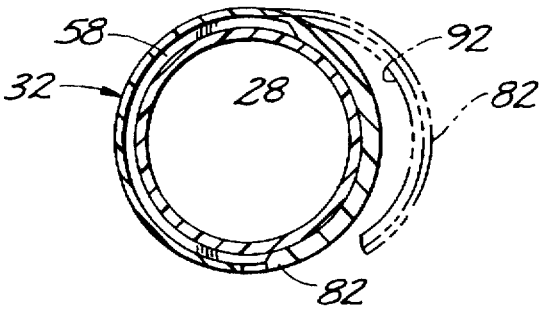
FIG. 16 is a cross-sectional view taken along the plane of line 16—16 of FIG. 15.
Figure 17:
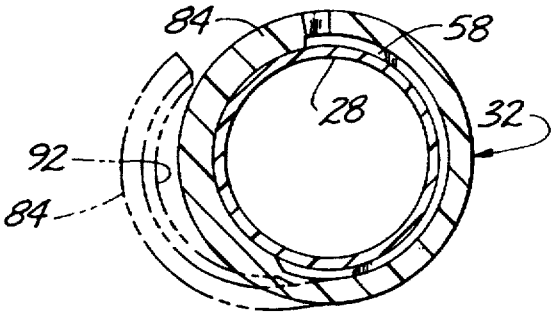
FIG. 17 is a cross-sectional view taken along the plane of line 17—17 of FIG. 15.

As best shown in FIGS. 16 and 17, the inner surface of each of the upper and lower resilient tabs 82, 84 includes an arcuate-shaped tongue 92 configured for extending into and engaging the grooves 58 of the post 28. The tongue 92 and the grooves 58 constitute mating lock elements for resisting axial movement of the second collar 32 relative to the post 28. When the post 28 is in the post-receiving cavity 90 of the second collar 32, the upper tab 82 is resiliently moveable in a plane generally perpendicular to the axis of the post between a post engaging (or gripping) position (shown in solid in FIG. 16) and a release position (shown in phantom in FIG. 16). The lower tab 84 is also resiliently moveable in a plane generally perpendicular to the axis Z of the post 28 between a post engaging position (shown in solid in FIG. 17) and a release position (shown in phantom in FIG. 17). The tongues 92 of the tabs 82, 84 extend into and engage the grooves 58 of the posts 28 when the tabs are in their post engaging positions for locking against axial movement of the second collar 32 relative to the post 28. The tongues 92 are radially spaced from the surface of the post when the resilient tabs 82, 84 are flexed to their release positions. With the tongues 92 in their release positions, the second collar 32 is free to slide along the surface of the post 28 to adjust the axial position of the collar 32 relative to the post. Preferably, the tabs 82, 84 are formed to assume their post engaging positions when no force acts on them to move them radially outward. In other words, the inherent resiliency of the tabs 82, 84 urges them back toward their post engaging positions after they have been flexed to their release positions.

Figure 15:
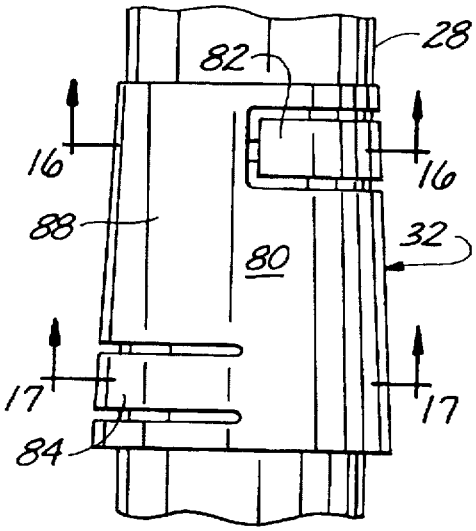
FIG. 15 is a fragmented side-elevational view of a second type colar surrounding the post.
Figure 18:
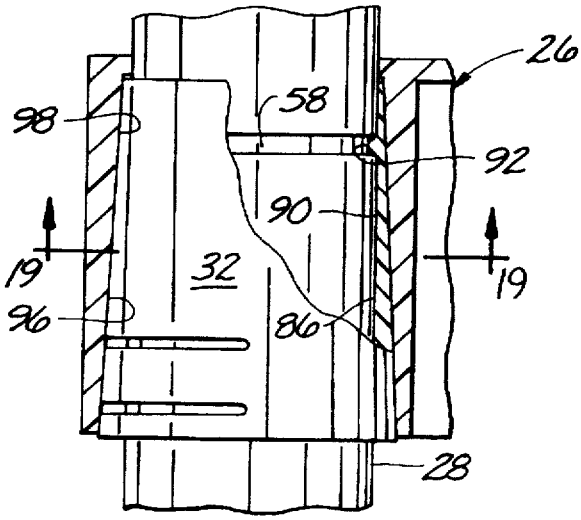
FIG. 18 is a fragmented side-elevational view of the collar of FIG. 15 inserted into a collar-receiving socket of a lower shelf of the shelving apparatus of FIG. 1.
Figure 19:
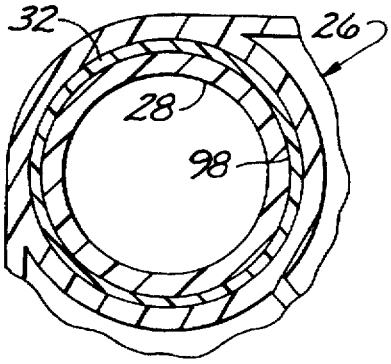
FIG. 19 is a cross-sectional view taken along the plane of line 19—19 of FIG. 18.

The lower shelf 26 has a support surface 94 for supporting articles placed thereon, and four through openings 96 adjacent the four corners of the shelf. The openings 96 constitute collar-receiving sockets for receiving the second collars 32. Each collar-receiving socket 96 (FIGS. 18 and 19) is defined by a substantially smooth collar engaging surface 98 engageable with the outer surface 88 of the collar 32. The collar engaging surface 98 and the outer surface 88 of the second collar 32 are shaped and configured for a snug sliding fit of the collar in the socket when the collar is positioned on the post. In particular, the outer surface 88 of each collar 32 tapers generally from bottom to top (as shown in FIGS. 15 and 18) and the collar-engaging surface 98 likewise tapers from bottom to top (as shown in FIG. 18). When the second collar 30 is positioned on the post 28 and inserted upward into the collar-receiving socket 96 (see FIGS. 18 and 19), the tapered outer surface 88 of the collar cooperates with the tapered collar-engaging surface 98 to snugly hold the collar in the socket. Thus, the lower shelf 26 is supported on the posts 28 via the collars 32.

To assemble the shelving apparatus 20, the lower shelf 26 is attached to the posts 28, and then the intermediate shelf 24 is attached, and then the upper shelf 22 is attached.

To attach the lower shelf 26 to the posts 28, the second collars 32 must first be secured to the posts. The user manually grasps the tabs 82, 84 of one of the second collars 32 and pulls them outward toward their release position. With the tabs so positioned, the user then slides the second collar 32 over the top of one of the posts 28 and down to a desired height for the lower shelf 26. The user then releases his/her grasp on the tabs 82, 84 and allows them to snap back to their post-engaging positions where the tongues 92 of the tabs extend into and engage two adjacent grooves 58 of the post 28 to axially lock the second collar 32 to the post. Because of the shape and configuration of the tongues 92 and grooves 58, engagement of the tongues and grooves resists axial (up and down) movement of the collar 32 relative to the post 28 regardless of the circumferential position of the collar. In other words, the collar 32 may be rotated on the post 28 without disengaging the tongues 82 from the grooves 58. After the second collar 32 is positioned on the post 28 at a desired height, then the other three second collars are positioned on their respective posts, preferably at the same height. The lower shelf 26 is then placed over the upper ends of the posts 28 and the posts are moved upwardly through the collar-receiving sockets (opening) 96 until the four collars 32 extend upward into the collar receiving sockets 96 and in engagement with the collar engaging surfaces 98.

To attach the intermediate shelf 24 to the posts 28, the C-shaped collars 30 are secured to the posts. The user orients the gap of the C-shaped collar 30 towards the surface of the post 28 and brings the side edges 64, 66 of the collar 30 into contact with the surface of the post. The user then pushes against the C-shaped collar 30 to move it laterally towards the axis Z of the post. The pushing on the collar forces the side edges (or camming surfaces) 64, 66 against the surface of the post 28 and thereby causes the gap to widen to its flexed position (FIG. 8) to facilitate passage of the post through the gap and into the post-receiving cavity 70. After the post 28 is inserted in the post-receiving cavity 70, the C-shaped collar 30 springs (or snaps) back to its relaxed position. When the C-shaped collar 30 springs back to its relaxed position, it grips the post 58 to resist lateral movement of the collar relative to the post and the tongues 68 engage the grooves 58 of the post to prevent axial movement of the collar relative to the tongue. To adjust the axial position of the C-shaped collar 30 on the post 28, the collar is detached from the post by pulling it laterally from the post and then reattached at a different axial position by pushing it laterally against the post so that the tongues 68 of the collar engages other grooves 58 of the post. Preferably, all four C-shaped collars 30 are attached to their corresponding posts at the same height so that the intermediate shelf 24 as supported is level. The intermediate shelf 24 is then placed over the upper ends of the posts 28 and the posts are moved upwardly through the collar-receiving sockets (openings) 74 until the C-shaped collars 30 extend upward into the collar receiving sockets and in engagement with the collar engaging surfaces 76.

The upper shelf 22 is attached to the posts 28 in the same manner as the intermediate shelf.

Because of the locking engagement between the collars 30, 32 and posts 28, and because of the snug fit of the collars in the sockets 74, 96, the collars support the shelves 22, 24, 26 on the posts. Also, because the collars 30, 32 are locked to the posts 28 independent of any forces exerted by the shelves, the collars will not slide axially along the posts even if the shelves are bumped or jostled.

Because of the configuration of the collars 30, 32, posts 28, and sockets 74, 96, therefore, the shelving apparatus 20 may be quickly and easily assembled into a sturdy and stable structure, and the height of the shelves may be quickly and easily adjusted.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense. The invention therefore shall be limited solely by the scope of the claims set forth below.

What is claimed is:

1. An adjustable shelving apparatus comprising:

at least one shelf having a support surface for supporting articles placed thereon;

at least one upright post sized for extending through an opening in the shelf, the post having a plurality of lock elements on the surface thereof;

at least one collar configured for at least partially encompassing the post, the collar having an inner surface, an outer surface, and at least one lock element on the inner surface of the collar engageable with the lock elements of the post;

said lock elements of the post and said lock element of the collar being shaped and configured for preventing axial movement of the collar relative to the post when said lock element of the collar engages at least one of said lock elements of the post;

the collar being resiliently deformable between a gripping position and a release position, the lock element of the collar engaging at least one of the lock elements of the post when the collar at least partially encompasses the post and is in its gripping position to lock against axial displacement of the collar relative to the post, the lock element of the collar being radially spaced from the lock elements of the post when the collar is in its release position to permit axial displacement of the collar relative to the post, the resiliency of the collar biasing the collar in its gripping position independent of any external forces pressing against the collar to releasably maintain engagement of said lock element of the collar with said at least one of the lock elements of the post;

the lock element of the collar and the lock elements of the post being shaped and configured for locking against axial movement of the collar relative to the post regardless of the circumferential position of the collar relative to the post;

the opening through the shelf comprising a collar-receiving socket for receiving the collar;

the collar-receiving socket being configured to receive the collar in a manner so that the collar supports the shelf on the post.

2. An adjustable shelving apparatus as set forth in claim 1 wherein the locking elements of the post comprise a plurality of axially-spaced circumferential grooves in the surface of the post, and wherein the locking element of the collar comprises a tongue configured for extending into and engaging the grooves.

3. An adjustable shelving apparatus as set forth in claim 2 wherein the tongue of the collar has a generally arcuate shape.

4. An adjustable shelving apparatus as set forth in claim 3 wherein the inner surface of the collar and the surface of the post are configured for permitting rotation of the collar about the axis of the post to adjust the circumferential position of the collar relative to the post while maintaining engagement of the tongue in the groove.

5. An adjustable shelving apparatus as set forth in claim 1 wherein the collar-receiving socket and the outer surface of the collar are shaped and configured for a sliding friction fit of the collar in the collar-receiving socket.

6. An adjustable shelving apparatus as set forth in claim 5 wherein the outer surface of the collar is tapered generally from one end of the collar to the other end and wherein the collar-receiving socket is tapered for nestably receiving the collar.

7. An adjustable shelving apparatus as set forth in claim 1 wherein:

the collar has first and second camming surfaces spaced apart to define a gap therebetween;

the inner surface of the collar defines a post-receiving cavity; and the collar is resiliently moveable between (a) a first position in which the gap is at least as wide as the diameter of the post to permit insertion of the post into and removal of the post from the post-receiving cavity via the gap and (b) a second position in which the gap is less than the diameter of the post.

8. An adjustable shelving apparatus as set forth in claim 7 wherein the collar is generally C-shaped in transverse cross-section.

9. An adjustable shelving apparatus as set forth in claim 8 wherein the surface of the post is generally circular in transverse cross-section.

10. An adjustable shelving apparatus as set forth in claim 7 wherein the collar is shaped and configured so that when the collar is in a relaxed position and the camming surfaces are in engagement with the surface of the post, movement of the collar laterally towards the axis of the post causes resultant forces from the surface of the post to press against the camming surfaces thereby to resiliently increase the gap sufficiently to facilitate passage of the post through the gap and into the post-receiving cavity independent of any other forces tending to widen the gap, the relaxed position of the collar being defined as the position which the collar assumes when substantially no external forces act on the collar to widen or narrow the gap between the first and second caming surfaces.

11. An adjustable shelving apparatus as set forth in claim 7 wherein the collar has a generally arcuate shape in transverse cross-section, the inner surface of the collar forming an arc which is greater than $\pi$ radians but less than $1\frac{1}{3}\pi$ radians.

12. An adjustable shelving apparatus as set forth in claim 1 wherein the collar comprises a collar body configured for at least partially encompassing the post and a resilient tab connected to the collar body, the collar body having an inner surface defining a post-receiving cavity and an outer surface, said lock element of the collar being on an inner surface of the resilient tab, said resilient tab being resiliently moveable in a plane generally perpendicular to the axis of the post when the post is in the post-receiving cavity of the collar between a post engaging position and a release position, the lock element of the collar engaging the surface of the post when the resilient tab is in its post engaging position, the inner surface of the resilient tab being radially spaced from the surface of the post when the resilient tab is in its release position.

13. An adjustable shelving apparatus as set forth in claim 12 wherein the collar is axially slidable on the post when the resilient tab of the collar is in its release position.

14. An adjustable shelving apparatus as set forth in claim 1 wherein the collar further comprises first and second side edges spaced apart to define a gap extending therebetween from one end of the collar to the other, the inner surface of the collar defining a post-receiving cavity, the collar being resiliently expandable to widen the gap for facilitating emplacement of the collar around and removal of the collar from the post.

15. An adjustable shelving apparatus as set forth in claim 14 wherein the collar-receiving socket includes a radially inwardly extending protrusion configured for extending through the gap of the collar and engaging the surface of the post for minimizing wobbling of the shelf relative to the post when the collar is on the post and is in the collar-receiving socket.

16. An adjustable shelving apparatus as set forth in claim 1 wherein the post comprises upper and lower post sections and a resilient snap connector generally at one end of one of the upper and lower post sections for releasably connecting the post sections end-to-end.

17. An adjustable shelving apparatus as set forth in claim 16 wherein:

the snap connector comprises a longitudinally extending arm at one end of one of the upper and lower post sections, and a finger extending radially outward from the arm; and the other of the upper and lower post sections includes an opening for receiving the finger of the snap connector to releasably lock the upper and lower post sections together.

18. An adjustable shelving apparatus comprising:

at least one shelf having a support surface for supporting articles placed thereon;

at least one upright post sized for extending through an opening in the shelf, the post having a plurality of spaced circumferential grooves in the surface thereof;

at least one collar configured for at least partially encompassing the post, the collar having an inner surface, an outer surface, and at least one lock element projecting radially inwardly from the inner surface of the collar for extending into one of the circumferential grooves of the post;

the grooves of the post and said lock element of the collar being shaped and configured for preventing axial movement of the collar relative to the post when said lock element of the collar extends into one of the grooves of the post;

the collar being resiliently deformable between a gripping position and a release position, the lock element of the collar extending into one of the grooves when the collar is in its gripping position and at least partially encompasses the post to lock against axial displacement of the collar relative to the post, the lock element of the collar being radially spaced from the grooves of the post when the collar is in its release position to permit axial displacement of the collar relative to the post, the resiliency of the collar biasing the collar in its gripping position independent of any external forces pressing against the collar to releasably maintain the collar in its gripping position;

the lock element of the collar and the grooves of the post being shaped and configured for locking against axial movement of the collar relative to the post regardless of the circumferential position of the collar relative to the post;

the opening through the shelf comprising a collar-receiving socket for receiving the collar;

the collar-receiving socket being configured to receive the collar in a manner so that the collar supports the shelf on the post.

19. An adjustable shelving apparatus as set forth in claim 18 wherein the locking element of the collar comprises a tongue configured for extending into and engaging the grooves.

20. An adjustable shelving apparatus as set forth in claim 19 wherein the collar and post are configured for releasably axially locking the collar on the post in any one of a plurality of discrete axial positions by disengaging the tongue of the collar from one of the grooves of the post and engaging the tongue with another of the grooves.

21. An adjustable shelving apparatus as set forth in claim 19 wherein the collar is configured for a resilient snap connection of the tongue in the groove.

22. An adjustable shelving apparatus as set forth in claim 19 wherein the tongue of the collar has a generally arcuate shape.

23. An adjustable shelving apparatus as set forth in claim 19 wherein the collar includes a resilient tab, the tongue of the collar being on an inner surface of the resilient tab, the resilient tab being configured for a resilient snap connection of the tongue in the groove.

24. An adjustable shelving apparatus as set forth in claim 23 wherein the inner surface of the collar defines a post-receiving cavity, and wherein the resilient tab is configured for urging the tongue inwardly into the post-receiving cavity.

25. An adjustable shelving apparatus as set forth in claim 18 wherein the collar-receiving socket and the outer surface of the collar are shaped and configured for a sliding friction fit of the collar in the collar-receiving socket.

26. An adjustable shelving apparatus as set forth in claim 18 wherein the collar has first and second camming surfaces spaced apart to define a gap therebetween.

27. An adjustable shelving apparatus as set forth in claim 18 wherein the collar is generally C-shaped in transverse cross-section.

28. An adjustable shelving apparatus as set forth in claim 27 wherein the collar has a generally arcuate shape in transverse cross-section, the inner surface of the collar forming an arc which is greater than $\pi$ radians but less than $1\frac{1}{3}\pi$ radians.

29. An adjustable shelving apparatus comprising:

at least one shelf having a support surface for supporting articles placed thereon;

at least one upright post sized for extending through an opening in the shelf;

at least one collar configured for partially encompassing the post, the collar having an inner surface engageable with the surface of the post, an outer surface, and first and second camming surfaces spaced apart to define a gap therebetween, the inner surface of the collar defining a post-receiving cavity;

the collar being resiliently moveable between (a) a first position in which the gap is at least as wide as the diameter of the post to permit insertion of the post into and removal of the post from the post-receiving cavity via the gap and (b) a second position in which the gap is less than the diameter of the post;

the inner surface of the collar and the surface of the post being shaped and configured for resisting relative lateral movement between the post and collar and for resisting relative axial movement between the post and collar when the post is within the post-receiving cavity of the collar and when the inner surface of the collar is in engagement with the surface of the post;

the collar being shaped and configured so that when the collar is in a relaxed position and the camming surfaces are in engagement with the surface of the post, movement of the collar laterally towards the axis of the post causes resultant forces from the surface of the post to press against the camming surfaces thereby to resiliently increase the gap sufficiently to facilitate passage of the post through the gap and into the post-receiving cavity independent of any other forces tending to widen the gap;

the relaxed position of the collar being defined as the position which the collar assumes when substantially no external forces act on the collar to widen or narrow the gap between the first and second camming surfaces, the gap between the first and second camming surfaces being less than the diameter of the post when the collar is in its relaxed position;

the opening in the shelf comprising a collar-receiving socket for receiving the collar;

the collar-receiving socket being configured to receive the collar in a manner so that the collar supports the shelf on the post.

30. An adjustable shelving apparatus as set forth in claim 29 wherein the post includes a plurality of axially-spaced circumferential grooves in the surface thereof, and wherein the inner surface of the collar includes a tongue configured for extending into and engaging the grooves.

31. An adjustable shelving apparatus as set forth in claim 30 wherein the tongue of the collar has a generally arcuate shape.

32. An adjustable shelving apparatus as set forth in claim 29 wherein the collar is generally C-shaped in transverse cross-section.

33. An adjustable shelving apparatus as set forth in claim 29 wherein the collar has a generally arcuate shape in transverse cross-section, the inner surface of the collar forming an arc which is greater than $\pi$ radians but less than approximately $1\frac{1}{3}\pi$ radians when the collar is in its relaxed position.

34. An adjustable shelving apparatus as set forth in claim 29 further comprising:

a second shelf having a support surface for supporting articles placed thereon;

a second collar having a collar body configured for at least partially encompassing the post and a resilient tab connected to the collar body, the collar body having an inner surface defining a post-receiving cavity and an outer surface, the resilient tab having an inner surface engageable with the surface of the post and being resiliently moveable in a plane generally perpendicular to the axis of the post when the post is in the post-receiving cavity of the second collar between a post engaging position and a release position, the inner surface of the resilient tab engaging the surface of the post when the resilient tab is in its post engaging position, the inner surface of the resilient tab being radially spaced from the surface of the post when the resilient tab is in its release position;

the inner surface of the resilient tab and the surface of the post being shaped and configured for preventing axial movement of the second collar relative to the post when the resilient tab is in its post engaging position, the second collar being axially slidable on the post when the resilient tab is in its release position;

a collar-receiving socket in the second shelf for receiving the second collar;

the collar-receiving socket of the second shelf and the outer surface of the second collar being shaped and configured for a friction fit of the second collar in the socket so that the second collar supports the second shelf on the post.

35. An adjustable shelving apparatus comprising:

at least one shelf having a support surface for supporting articles placed thereon;

at least one upright post sized for extending through an opening in the shelf;

at least one collar having a collar body configured for at least partially encompassing the post and a resilient tab connected to the collar body, the collar body having an inner surface defining a post-receiving cavity and an outer surface, the resilient tab having an inner surface engageable with the surface of the post and being resiliently moveable in a plane generally perpendicular to the axis of the post when the post is in the post-receiving cavity of the collar between a post engaging position and a release position, the inner surface of the resilient tab engaging the surface of the post when the resilient tab is in its post engaging position, the inner surface of the resilient tab being radially spaced from the surface of the post when the resilient tab is in its release position;

the inner surface of the resilient tab and the surface of the post being shaped and configured for preventing axial movement of the collar relative to the post when the resilient tab is in its post engaging position, the collar being axially slidable on the post when the resilient tab of the collar is in its release position;

the opening in the shelf comprising a collar-receiving socket for receiving the collar;

the collar-receiving socket being configured to receive the collar in a manner so that the collar supports the shelf on the post;

the post including a plurality of axially-spaced circumferential grooves in the surface thereof;

the inner surface of the resilient tab including a tongue configured for extending into and engaging the grooves.

36. An adjustable shelving apparatus as set forth in claim 35 wherein the tongue of the collar has a generally arcuate shape.

37. An adjustable shelving apparatus as set forth in claim 35 wherein the resilient tab is generally arcuater in shape.

38. An adjustable shelving apparatus as set forth in claim 35 further comprising:

a second shelf having a support surface for supporting articles placed thereon;

a second collar configured for partially encompassing the post, the second collar having an inner surface engageable with the surface of the post, an outer surface, and first and second side edges spaced apart to define a gap extending therebetween from one end of the second collar to the other, the inner surface of the second collar defining a post-receiving cavity, the second collar being resiliently flexible in a manner to widen the gap for facilitating emplacement of the second collar around removal of the second collar from the post;

the inner surface of the second collar and the surface of the post being shaped and configured for resisting relative axial movement between the post and second collar when the post is within the post-receiving cavity of the second collar and when the inner surface of the second collar is in engagement with the surface of the post;

a collar-receiving socket in the second shelf for receiving the second collar;

the collar-receiving socket of the second shelf and the outer surface of the second collar being shaped and configured for a friction fit of the second collar in the socket;

the collar-receiving socket of the second shelf including a radially inwardly extending protrusion configured for extending through the gap of the second collar and engaging the surface of the post for minimizing wobbling of the second shelf relative to the post when the second collar is on the post and is frictionally fit in the collar-receiving socket of the second shelf.

39. An adjustable shelving apparatus comprising:

at least one shelf having a support surface for supporting articles placed thereon;

at least one upright post sized for extending through an opening in the shelf;

at least one collar configured for partially encompassing the post, the collar having an inner surface engageable with the surface of the post, an outer surface, and first and second side edges spaced apart to define a gap extending therebetween from one end of the collar to the other, the inner surface of the collar defining a post-receiving cavity, the collar being resiliently expandable to widen the gap for facilitating emplacement of the collar around and removal of the collar from the post;

the inner surface of the collar and the surface of the post being shaped and configured for resisting relative axial movement between the post and collar when the post is within the post-receiving cavity of the collar and when the inner surface of the collar is in engagement with the surface of the post;

the opening in the shelf comprising a collar-receiving socket for receiving the collar;

the collar-receiving socket and the outer surface of the collar being shaped and configured for a friction fit of the collar in the socket;

the collar-receiving socket including a radially inwardly extending protrusion configured for extending through the gap of the collar and engaging the surface of the post for minimizing wobbling of the shelf relative to the post when the collar is on the post and is frictionally fit in the collar-receiving socket.

40. An adjustable shelving apparatus as set forth in claim 39 wherein the post includes a plurality of axially-spaced circumferential grooves in the surface thereof, and wherein the inner surface of the collar includes a tongue configured for extending into and engaging the grooves.

41. An adjustable shelving apparatus as set forth in claim 39 wherein the collar is generally C-shaped in transverse cross-section.

42. An adjustable shelving apparatus as set forth in claim 39 wherein the collar has a generally arcuate shape in transverse cross-section, the inner surface of the collar forming an arc which is greater than $\pi$ radians but less than approximately $1\frac{1}{3}\pi$ radians.

43. An adjustable shelving apparatus as set forth in claim 39 further comprising:

a second shelf having a support surface for supporting articles placed thereon;

a second collar having a collar body configured for at least partially encompassing the post and a resilient tab connected to the collar body, the collar body having an inner surface defining a post-receiving cavity and an outer surface, the resilient tab having an inner surface engageable with the surface of the post and being resiliently moveable in a plane generally perpendicular to the axis of the post when the post is in the post-receiving cavity of the second collar between a post engaging position and a release position, the inner surface of the resilient tab engaging the surface of the post when the resilient tab is in its post engaging position, the inner surface of the resilient tab being radially spaced from the surface of the post when the resilient tab is in its release position;

the inner surface of the resilient tab and the surface of the post being shaped and configured for preventing axial movement of the second collar relative to the post when the resilient tab is in its post engaging position, the second collar being axially slidable on the post when the resilient tab is in its release position;

a collar-receiving socket in the second shelf for receiving the second collar;

the collar-receiving socket of the second shelf and the outer surface of the second collar being shaped and configured for a friction fit of the second collar in the socket so that the second collar supports the second shelf on the post.

44. An adjustable shelving apparatus comprising:

at least one shelf having a support surface for supporting articles placed thereon;

at least one upright post, the post comprising upper and lower post sections and a resilient snap connector generally at the end of one of the upper and lower post sections for releasably connecting the post sections end-to-end;

at least one collar configured for capturing the post, the collar having an inner surface engageable with the surface of the post and an outer surface;

the inner surface of the collar and the surface of the post being shaped and configured for resisting relative axial movement between the post and collar when the post is captured by the collar;

a collar-receiving socket in the shelf for receiving the collar;

the collar-receiving socket and the outer surface of the collar being shaped and configured for a friction fit of the collar in the socket.

45. An adjustable shelving apparatus as set forth in claim 44 wherein:

the snap connector comprises a longitudinally extending arm at one end of one of the upper and lower post sections, and a finger extending radially outward from the arm; and the other of the upper and lower post sections includes an opening for receiving the finger of the snap connector to releasably lock the upper and lower post sections together.

46. An adjustable shelving apparatus as set forth in claim 44 wherein each post section has a plurality of circumferential grooves spaced at substantially equal intervals along its length, the post sections being configured so that when they are connected end-to-end, then the spacing between the lowermost groove of the first section and the uppermost groove of the second section is substantially equal to the interval between other adjacent grooves.

47. An adjustable shelving apparatus comprising:

at least one shelf having a support surface for supporting articles placed thereon;

at least one upright post sized for extending through an opening in the shelf;

at least one collar having a collar body configured for at least partially encompassing the post and a resilient tab connected to the collar body, the collar body having an inner surface defining a post-receiving cavity and an outer surface, the resilient tab having an inner surface engageable with the surface of the post and being resiliently moveable relative to the collar body in a plane generally perpendicular to the axis of the post when the post is in the post-receiving cavity of the collar between a post engaging position and a release position, the inner surface of the resilient tab engaging the surface of the post when the resilient tab is in its post engaging position, the inner surface of the resilient tab being radially spaced from the surface of the post when the resilient tab is in its release position;

the inner surface of the resilient tab and the surface of the post being shaped and configured for preventing axial movement of the collar relative to the post when the resilient tab is in its post engaging position, the collar being axially slidable on the post when the resilient tab of the collar is in its release position;

the opening in the shelf comprising a collar-receiving socket for receiving the collar;

the collar-receiving socket being configured to receive the collar in a manner so that the collar supports the shelf on the post.

* * * * *